US007729836B2

(12) United States Patent
Gilchrist

(10) Patent No.: US 7,729,836 B2
(45) Date of Patent: Jun. 1, 2010

(54) PATCHER SYSTEM AND ASSOCIATED METHODS

(75) Inventor: Robert A. Gilchrist, Jackson, MS (US)

(73) Assignee: Duraco, Inc., Spring Lake, MI (US)

( * ) Notice: Subject to any disclaimer, the term of this patent is extended or adjusted under 35 U.S.C. 154(b) by 0 days.

(21) Appl. No.: 12/348,836

(22) Filed: Jan. 5, 2009

(65) Prior Publication Data

US 2009/0112411 A1 Apr. 30, 2009

Related U.S. Application Data

(62) Division of application No. 11/513,482, filed on Aug. 30, 2006, now Pat. No. 7,481,601.

(60) Provisional application No. 60/836,042, filed on Aug. 7, 2006.

(51) Int. Cl.
*G06F 19/00* (2006.01)

(52) U.S. Cl. ..... 701/50

(58) Field of Classification Search ..... 701/50; 404/72, 83, 84.05

See application file for complete search history.

(56) References Cited

U.S. PATENT DOCUMENTS 3,625,120 A 12/1971 Nagy
3,967,913 A 7/1976 Gabriel, Jr.
4,215,949 A 8/1980 Gabriel, Jr.
4,676,689 A 6/1987 Yant
4,704,046 A 11/1987 Yant
5,251,999 A 10/1993 McCracken
5,439,313 A 8/1995 Blaha et al.
7,481,601 B2 * 1/2009 Gilchrist ..... 404/109
2002/0015618 A1 2/2002 Quenzi et al.
2004/0240939 A1 * 12/2004 Hays et al. ..... 404/95

OTHER PUBLICATIONS

International Search Report issued in related PCT Patent Application Serial No. PCT/US2007/75381, dated May 16, 2008, 4 pages.
Written Opinion issued in related PCT Patent Application No. PCT/US2007/75381, dated May 16, 2008, 6 pages.
Article 19 amendments filed in related PCT Patent Application No. PCT/US2007/75381, dated Jul. 16, 2008, 13 pages.
U.S. Appl. No. 11/513,482, selected pages of Image File Wrapper, Jan. 25, 2008 through Jan. 27, 2009, 40 pages.

* cited by examiner

*Primary Examiner*—Yonel Beaulieu
(74) *Attorney, Agent, or Firm*—Lathrop & Gage LLP

(57) ABSTRACT

A patcher system for patching a paved surface includes a remotely controllable arm attachable to a vehicle and a patching material dispensing subsystem disposed on the remotely controllable arm. The patcher system may be part of a mobile patcher system which additionally includes a vehicle, a patching material distribution subsystem disposed on the vehicle, and a control subsystem. A software product may include instructions that, when executed by a computer, perform steps for controlling the patcher system.

7 Claims, 14 Drawing Sheets

PATCHER SYSTEM AND ASSOCIATED METHODS

CROSS-REFERENCE TO RELATED APPLICATIONS

This application is a divisional application of U.S. patent application Ser. No. 11/513,482, filed Aug. 30, 2006, now U.S. Pat. No. 7,481,601, which claims benefit of priority to U.S. Provisional Patent Application Ser. No. 60/836,042, filed 7 Aug. 2006. Each of the aforementioned patent applications are incorporated herein by reference.

BACKGROUND

Paved surfaces are commonly used to construct structures such as roads, sidewalks, and parking lots, and are usually constructed out of materials such as asphalt and concrete. Unfortunately, paved surfaces often develop imperfections ranging from small cracks to large holes. Such imperfections may occur naturally as the paved surfaces age. For example, asphalt and concrete roads deteriorate over time. Imperfections can also be caused by hostile environmental conditions, such as extreme weather, as well as by heavy use, such as heavy traffic on a road. Paved surfaces may also be intentionally cut open in order to obtain access to an area below the paved surface; for example, a road may need to be dug up in order to obtain access to an utility line located beneath the road.

Imperfections in paved surfaces are often repaired by filling the imperfection with patching material, which typically consists of hot mix asphalt, concrete, or cold mix asphalt. A pot-hole in a road may for example be filled with such patching material.

In the typical scenario, patching material is delivered to the area to be patched via a truck or a trailer. One or more operators then fill an imperfection by placing the patching material in the imperfection; an operator may for example shovel hot mix asphalt, concrete, or cold mix asphalt from the truck into the imperfection. Alternatively, an operator standing proximate to the imperfection may manually maneuver patching material dispensing equipment, such as a spray nozzle, to direct the patching material into the imperfection.

BRIEF SUMMARY

In an embodiment, a patcher system for patching a paved surface includes a remotely controllable arm attachable to a vehicle and a patching material dispensing subsystem disposed on the remotely controllable arm.

In an embodiment, a mobile patcher system for patching a paved surface with patching material includes a vehicle having a remotely controllable arm attached to the vehicle, wherein the remotely controllable arm may be extended from an exterior of the vehicle. The system further includes a patching material dispensing subsystem disposed on the remotely controllable arm and a patching material distribution subsystem disposed on the vehicle. The patching material distribution subsystem is in fluid communication with the patching material dispensing subsystem. The system further includes a control subsystem for controlling the mobile patcher system and a user control subsystem disposed within a passenger compartment of the vehicle for controlling user controllable operations of the mobile patcher system.

In an embodiment, a method of patching a paved surface includes positioning a vehicle having a remotely controllable arm proximate to an area of the paved surface to be patched. The remotely controllable arm is positioned such that a patching material dispensing subsystem disposed on the remotely controllable arm is proximate to the area of the paved surface to be patched. Patching material is caused to be injected from the patching material dispensing subsystem to the area of the paved surface to be patched.

In an embodiment, a software product includes instructions, stored on computer-readable media, wherein the instructions, when executed by a computer, perform steps for controlling a patcher system for patching a paved surface. The software product includes instructions for determining a current position of a joystick, instructions for determining if a trigger of a user control subsystem is activated, instructions for determining if a remotely controllable arm has reached at least one maximum position, instructions for determining if further movement of the remotely controllable arm would result in the remotely controllable arm exceeding at least one maximum position, and instructions for routing signals corresponding to the current position of the joystick to actuators associated with the remotely controllable arm.

DETAILED DESCRIPTION

Figure 1:
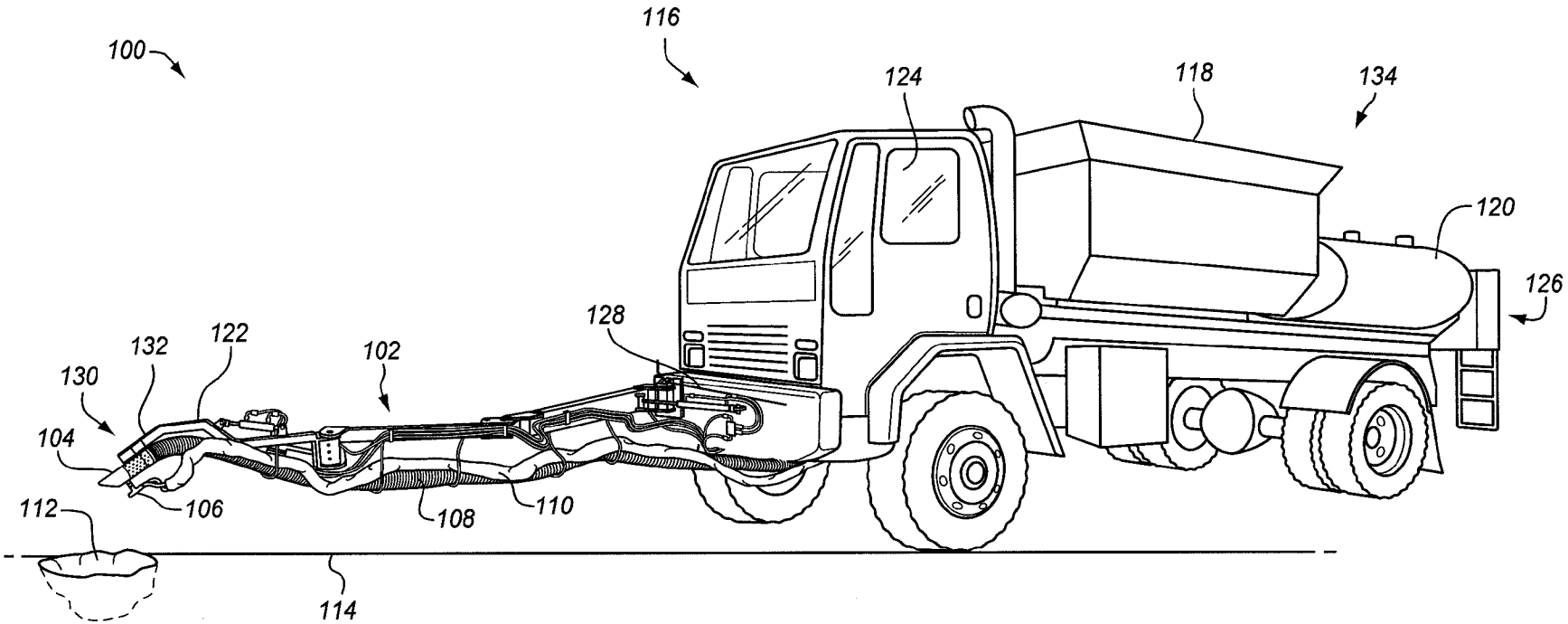
FIG. 1 is a perspective view of a patcher system, according to an embodiment.

FIG. 1 is a perspective view of patcher system 100. Patcher system 100 may be used to patch imperfections in a paved surface. For example, patcher system 100 may be used to patch pothole 112 in paved surface 114.

Patcher system 100 includes vehicle 116, which may be a truck. Vehicle 116 includes passenger compartment 124 and equipment area 126. Patching material distribution equipment 134, which stores patching material and helps deliver it to an area being patched, is located in equipment area 126. In an embodiment, patching material distribution equipment 134 includes aggregate dispensing subsystem 118 and emulsion distribution subsystem 120, discussed in more detail below with respect to FIG. 8.

Remotely controllable arm 102 is mounted to vehicle 116. In an embodiment, remotely controllable arm 102 is mounted to vehicle bumper 128. Remotely controllable arm 102 may be extended or retracted relative to vehicle 116. Distal end 132 of remotely controllable arm 102 may be remotely positioned in a selected three-dimensional location relative to vehicle 116. In an embodiment, remotely controllable arm 102 is controlled by control subsystem 900, discussed in more detail below with respect to FIG. 9; control subsystem 900 may include user control subsystem 904, which allows a user to control remotely controllable arm 102. If user control subsystem 904 is located within passenger compartment 124, a user, such as a driver of vehicle 116, may control remotely controllable arm 102 from within passenger compartment 124, for example. User control subsystem 904 will be discussed in more detail below with respect to FIG. 12.

Patching material dispensing subsystem 130 is disposed on remotely controllable arm 102. In an embodiment, patching material dispensing subsystem 130 is positioned on end member 122 located at distal end 132 of remotely controllable arm 102. Patching material dispensing subsystem 130 delivers patching material from patching material distribution equipment 134 to an area to be patched, such as pothole 112. Patching material distribution equipment 134 may be controlled by control subsystem 900 and user control subsystem 904.

In an embodiment, patching material dispensing subsystem 130 includes aggregate dispensing nozzle 104 and emulsion dispensing nozzle 106 disposed on distal end 132 of remotely controllable arm 102. Aggregate dispensing nozzle 104 is in fluid communication with aggregate distribution subsystem 118 via aggregate hose 108. Aggregate dispensing nozzle 104 delivers aggregate, such as crushed stone or gravel, to the area (e.g., pothole 112) to be patched. Emulsion dispensing nozzle 106 is in fluid communication with emulsion distribution subsystem 120 via emulsion line 110. Emulsion dispensing nozzle 106 delivers an asphalt emulsion, such as cationic or anionic emulsified asphalt, to the area to be patched.

Figure 2:
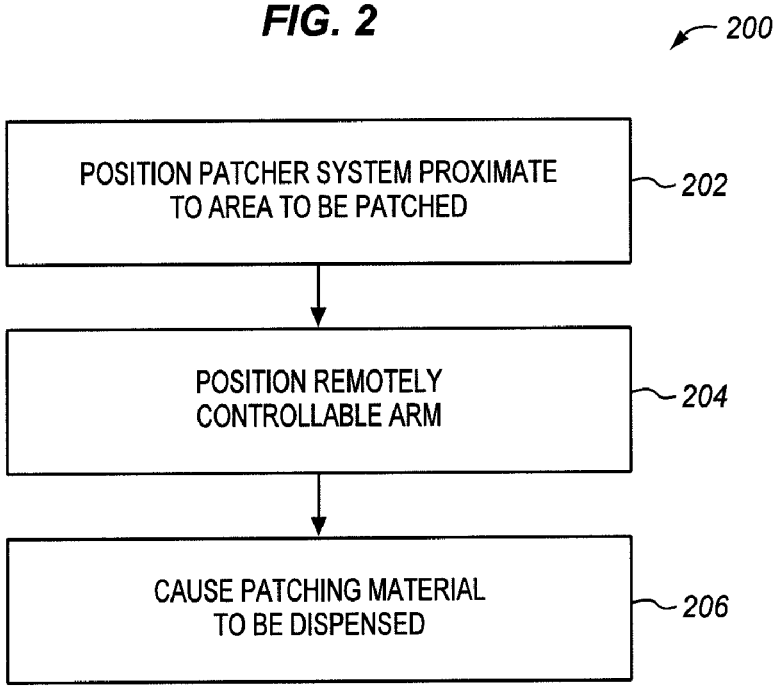
FIG. 2 schematically shows a method of patching a paved surface, according to an embodiment.

Accordingly, a single user, such as a driver of vehicle 116, may use patcher system 100 to patch an imperfection in a paved surface. FIG. 2 shows a method 200 which illustratively shows how patcher system 100 may be used to patch an imperfection in a paved surface. In step 202, patcher system 100 is positioned proximate to the area of the paved surface to be patched. In an example of step 202, a user drives vehicle 116 to a location near pothole 112. In step 204, remotely controllable arm 102 is positioned such that patching material dispensing subsystem 130 is proximate to the area of the paved surface to be patched. In an example of step 204, the user positions remotely controllable arm 102 such that patching material distribution subsystem 130 is located above pothole 112. In step 206, patching material is caused to be dispensed from patching material dispensing subsystem 130 to the area of the paved surface to be patched. In an example of step 206, the user adjusts user control subsystem 904 such that aggregate is delivered from aggregate dispensing nozzle 104 and asphalt emulsion is delivered from emulsion dispensing nozzle 106 into pothole 112.

Figure 3:
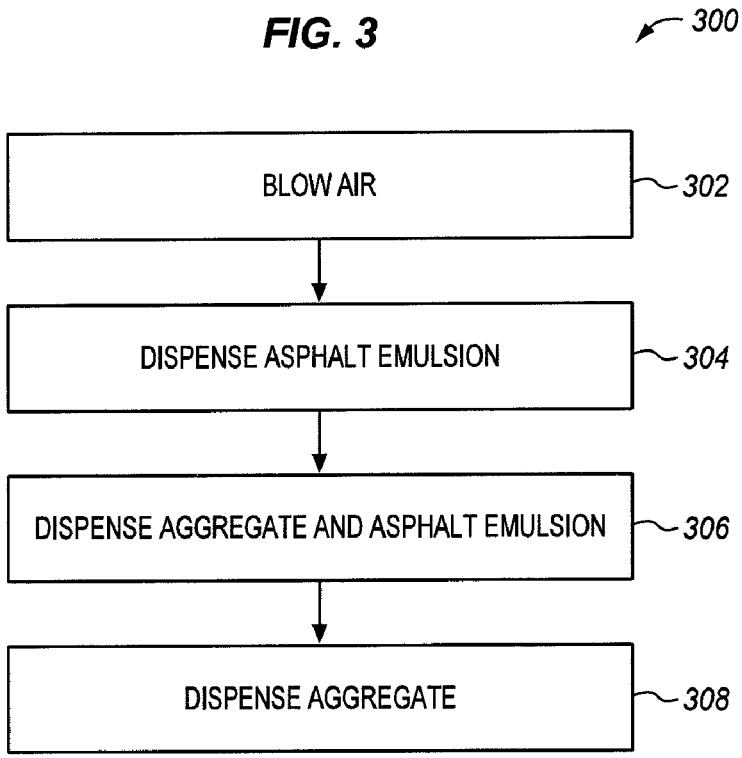
FIG. 3 schematically shows a method of filling an imperfection in a paved surface, according to an embodiment.

Step 206 may include the following sub-method 300. Sub-method 300 includes steps 302, 304, 306, and 308 as illustrated in FIG. 3. In step 302, the user causes air to be blown from aggregate dispensing nozzle 104 into the imperfection to help clean the imperfection. In an example of step 302, the user blows loose dirt out of pothole 112 using aggregate dispensing nozzle 104. In step 304, the user causes asphalt emulsion to be dispensed into the imperfection via emulsion dispensing nozzle 106. The layer of asphalt emulsion serves as tact to help aggregate adhere to the imperfection. In an example of step 304, the user applies a layer of asphalt emulsion to pothole 112 using emulsion dispensing nozzle 106 before filling pothole 112 with aggregate. In step 306, the user causes aggregate and asphalt emulsion to be simultaneously dispensed into the imperfection. In an example of step 306, aggregate is dispensed via aggregate dispensing nozzle 104, and asphalt emulsion is dispensed via emulsion dispensing nozzle 106—each under control of the user via user control subsystem 904. The combination of aggregate and asphalt emulsion serves as the bulk of the patching material. In step 308, the user causes a thin layer of aggregate to be dispensed over the patched imperfection. In an example of step 308, the user applies a thin layer of aggregate over filled pothole 112 using aggregate dispensing nozzle 104.

As noted above, remotely controllable arm 102 and patching material dispensing subsystem 130 may be controlled via user control subsystem 904, which is for example positioned within passenger compartment 124 of vehicle 116. Consequently, a single user may use patcher system 100 to repair an imperfection in a paved surface without leaving passenger compartment 124. Use of patcher system 100 may thereby promote safety because a user may repair an imperfection in a paved surface from the safety of passenger compartment 124; the user does not need to stand on the paved surface near the imperfection where the user may be exposed to dangerous traffic, hot and/or irritating patching material, and/or inclement weather. Additionally, use of patcher system 100 may promote economical repair of paved surfaces because patcher system 100 may be operated by a single user, and the user can conduct repairs without expending time entering and exiting vehicle 116.

Figure 4:
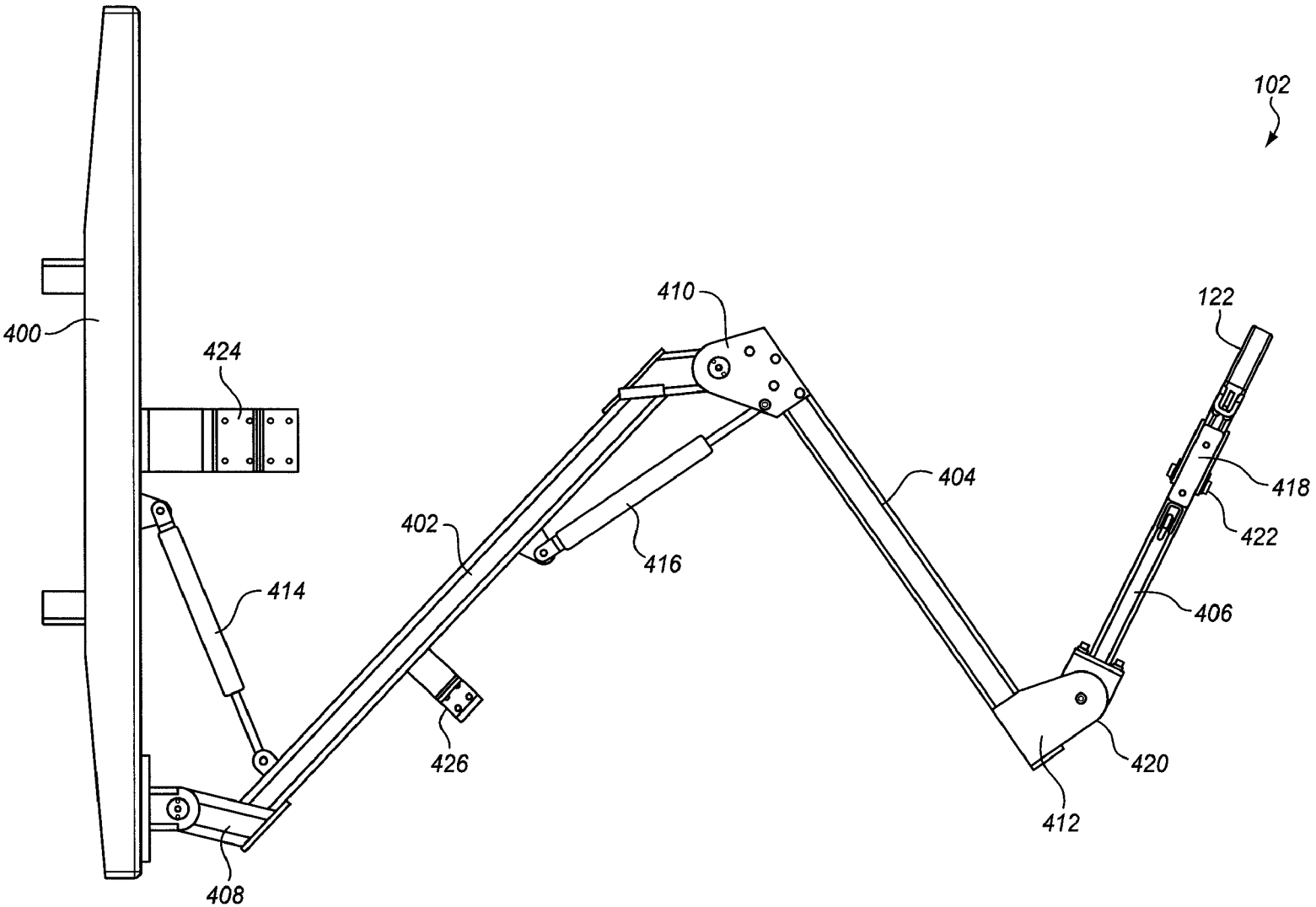
FIG. 4 is a top plan view of a remotely controllable arm, according to an embodiment.
Figure 5:
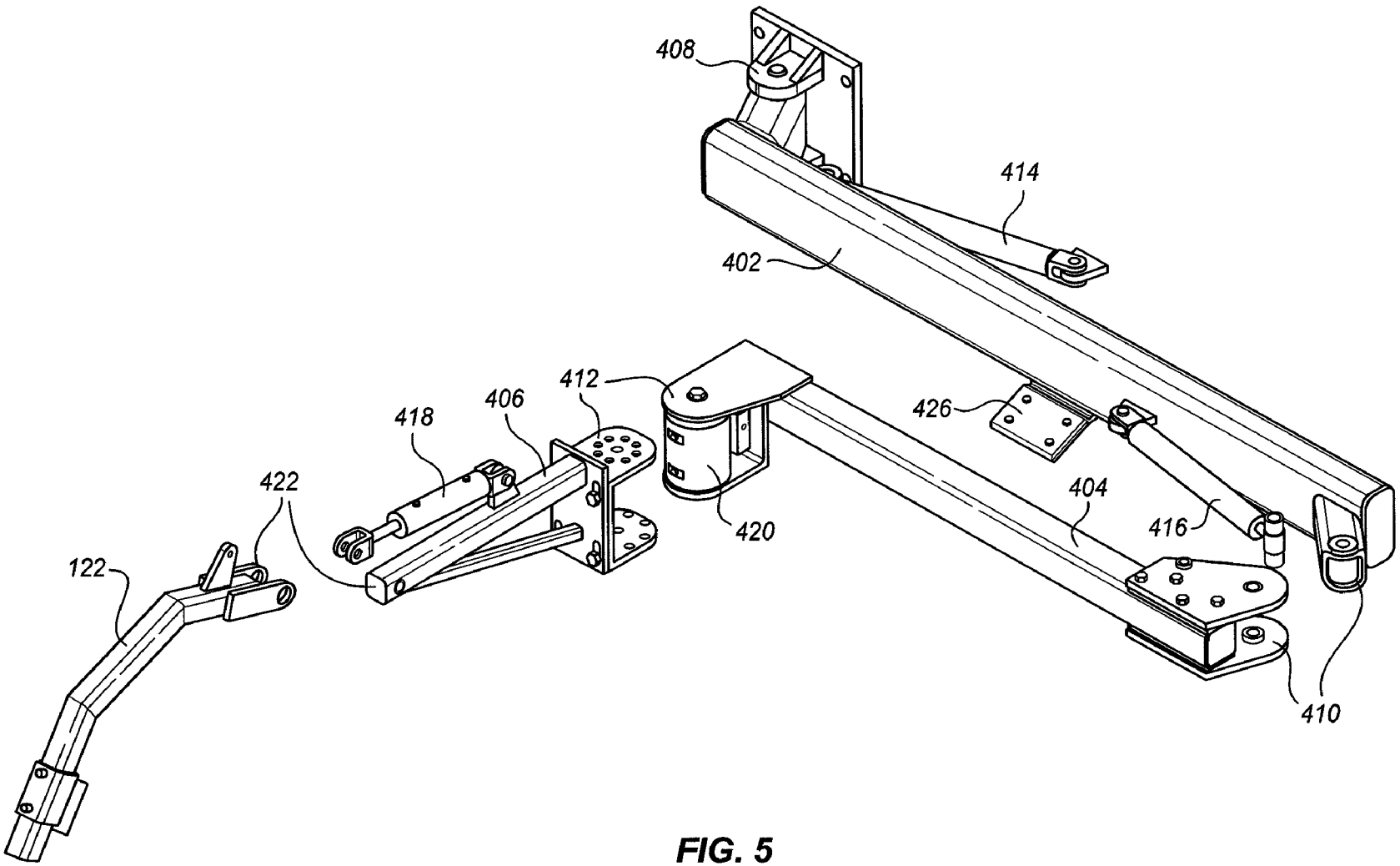
FIG. 5 is an exploded perspective view of the remotely controllable arm of FIG. 4, according to an embodiment.

Remotely controllable arm 102 is illustrated in FIGS. 4 and 5. FIG. 4 is a top plan view of remotely controllable arm 102; FIG. 5 is a exploded perspective view of remotely controllable arm 102. Remotely controllable arm 102 serves to support patching material dispensing subsystem 130. As discussed above, in an embodiment, patching material dispensing subsystem 130 includes aggregate dispensing nozzle 104 (not visible in FIGS. 4 and 5) and emulsion dispensing nozzle 106 (not visible in FIGS. 4 and 5). Aggregate dispensing nozzle 104 is connected to remotely controllable arm 102 via end member 122. Emulsion dispensing nozzle 106 is in turn connected to aggregate dispensing nozzle 104. Remotely controllable arm 102 may be positioned to place aggregate dispensing nozzle 104 and emulsion dispensing nozzle 106 at a desired location.

Remotely controllable arm 102 is attached to support structure 400. Although support structure 400 is illustrated in FIG. 4 as being a vehicle's bumper, support structure 400 may another suitable structure; for example, support structure 400 may be a vehicle's frame. Stow bracket 424 supports remotely controllable arm 102 when remotely controllable arm 102 is retracted, such as when a vehicle 116 is traveling.

Remotely controllable arm 102 includes members 402, 404, and 406. Hinge assembly 408 connects member 402 to support structure 400. Hinge assembly 408 allows member 402 to rotate horizontally with respect to support structure 400.

Actuator 414 moves member 402 horizontally with respect to support structure 400. Actuator 414 may be a hydraulically operated actuator controlled by hydraulic control subsystem 906, which is a subset of control subsystem 900. Hydraulic control subsystem 906 is discussed in more detail below with respect to FIG. 10.

Hinge assembly 410 connects member 404 to member 402. Hinge assembly 410 allows member 404 to rotate horizontally with respect to member 402. Stop bracket 426 prevents member 404 from directly contacting member 402 when remotely controllable arm 102 is retracted.

Actuator 416 moves member 404 horizontally with respect to member 402. Actuator 416 may be a hydraulically operated actuator controlled by hydraulic control subsystem 906.

Member 406 is connected to member 404 by hinge assembly 412. Hinge assembly 412 allows member 406 to rotate horizontally with respect to member 404. Included within hinge assembly 412 is rotary actuator 420. Rotary actuator 420 rotates member 406 horizontally with respect to member 404. In an embodiment, rotary actuator 420 is operated by hydraulic control subsystem 906. In other embodiments, rotary actuator 420 may be electrically operated.

Hinge assembly 422 connects end member 122 to member 406. Hinge assembly 422 allows end member 122 to rotate vertically with respect to member 406. Actuator 418 moves end member 122 vertically with respect to member 406. Actuator 420 may be controlled by hydraulic control subsystem 906.

As noted above, actuator 414 moves member 402 horizontally, and actuator 416 moves member 404 horizontally. Consequently, actuators 414 and 416 are operable to extend and retract remotely controllable arm 102 with respect to vehicle 116. Rotary actuator 420 rotates member 406 and end member 122 in a horizontal plane with respect to vehicle 116. Consequently, rotary actuator 420 controls the horizontal position of end member 122 and of, therefore, patching material dispensing subsystem 130. Actuator 418 rotates end member 122 in a vertical plane with respect to vehicle 116. Consequently, actuator 418 controls the vertical position of end member 122 and patching material dispensing subsystem 130. As discussed above, actuators 414, 416, and 418 as well as rotary actuator 420 may be controllable via hydraulic control subsystem 906 which is a subset of control subsystem 900. Consequently, control subsystem 900 may control the horizontal and vertical position of patching material dispensing subsystem 130.

In an embodiment, patcher system 100 limits a user's ability to extend remotely controllable arm 102 beyond a side of vehicle 116. For example, patcher system 100 may operate such that remotely controllable arm 102 is not extendable beyond the driver's side of vehicle 116, to prevent a user from accidentally extending remotely controllable arm 102 into a traffic lane. However, in an embodiment, patcher system 100 operates such that remotely controllable arm 102 extends up to 91 centimeters (36 inches) beyond the passenger side of vehicle 116, to allow a user to patch a road's shoulder, for example.

The mechanical structure of remotely controllable arm 102 may also limit a user's ability to extend remotely controllable arm 102 beyond the side of a vehicle. For example, the lengths of members 402, 404, and 406, as well the configurations of hinge assemblies 408, 410, and 412, affect how far a user can extend remotely controllable arm 102 beyond a side of vehicle 116. Additionally, control subsystem 900 may be configured to limit a user's ability to extend remotely controllable arm 102 beyond a side of vehicle 116.

Figure 6:
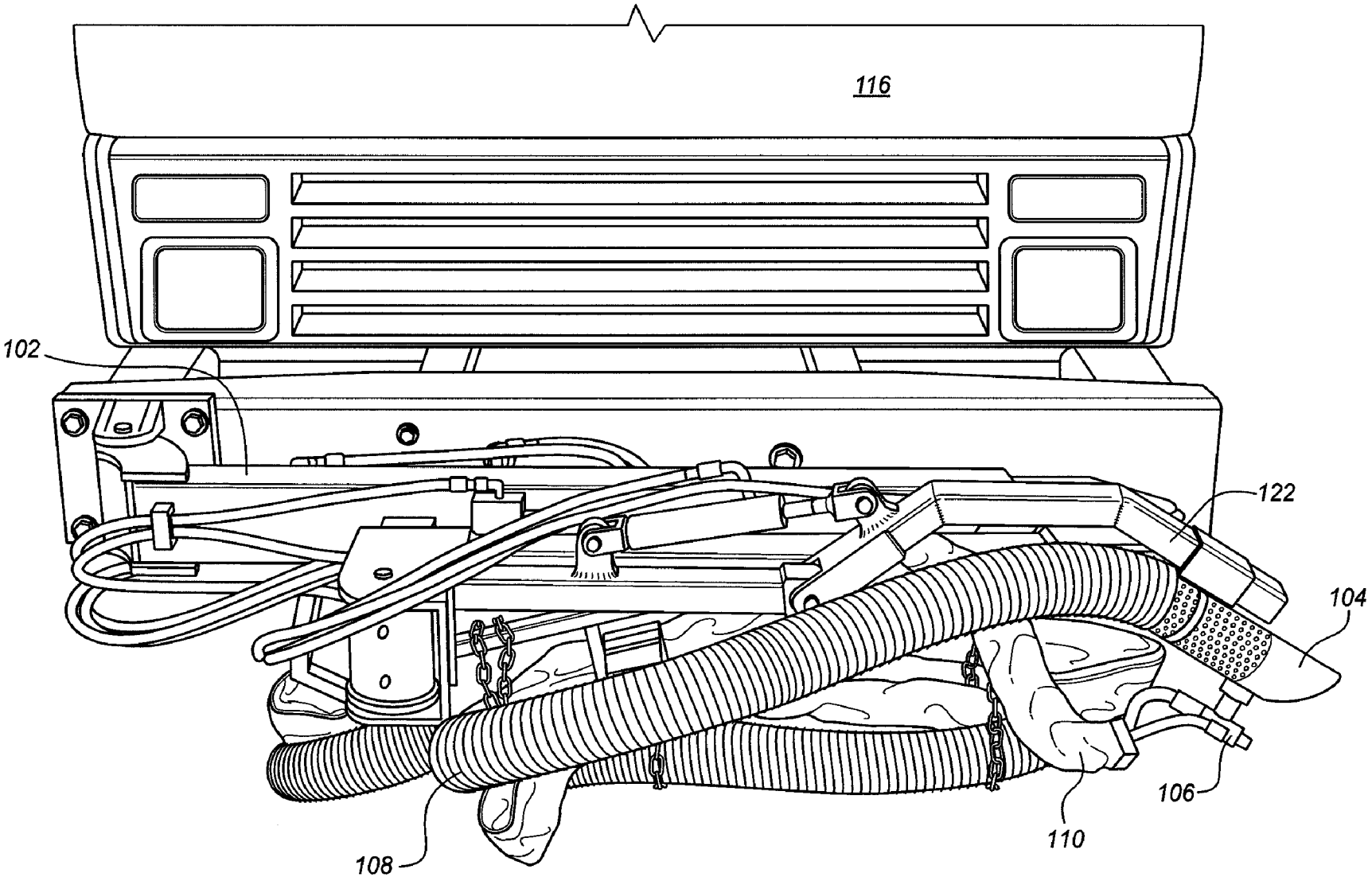
FIG. 6 is a front perspective view of the patcher system of FIG. 1, according to an embodiment.

FIG. 6 is perspective view of patcher system 100, in an embodiment. Remotely controllable arm 102 is shown retracted in FIG. 6. Remotely controllable arm 102 is generally retracted when patcher system 100 is not in use. In particular, remotely controllable arm 102 is retracted when vehicle 116 is in motion.

Figure 7:
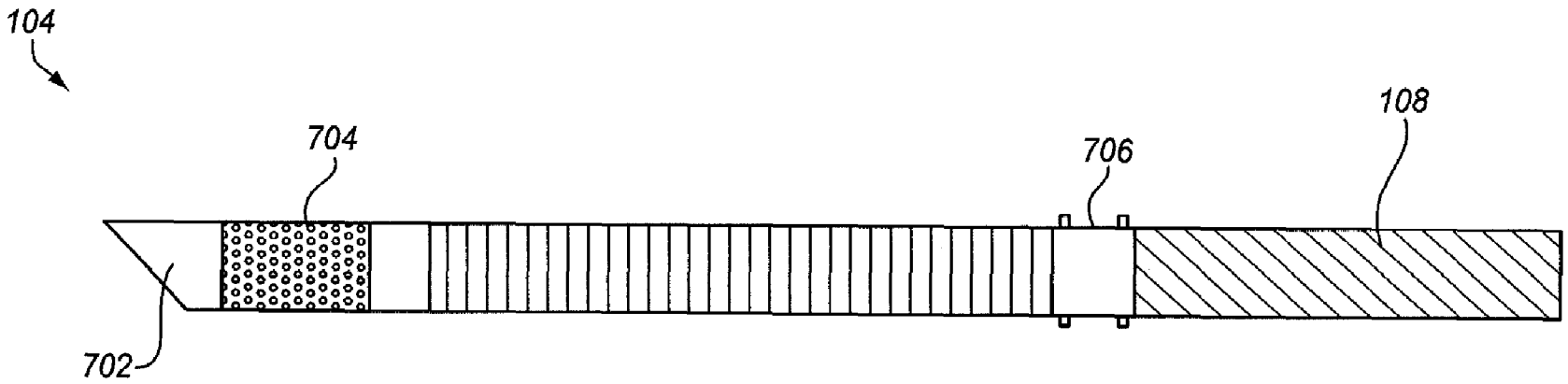
FIG. 7 is a side plan view of an aggregate dispensing nozzle, according to an embodiment.

FIG. 7 is a side plan view of aggregate dispensing nozzle 104. As discussed above, aggregate dispensing nozzle 104 dispenses aggregate material and may be attached to end member 122 of remotely controllable arm 102.

An embodiment of aggregate dispensing nozzle 104 includes sloped end 702 and perforated holes 704. Perforated holes 704 relieve air pressure when aggregate exits aggregate dispensing nozzle 104. Such relief of air pressure helps prevent aggregate from being blown beyond an area of the paved surface to be patched.

Aggregate dispensing nozzle 104 is connected to aggregate hose 108 via clamps 706. As discussed above, aggregate hose 108 delivers aggregate material from aggregate distribution system 118 to aggregate dispensing nozzle 104.

Figure 8:
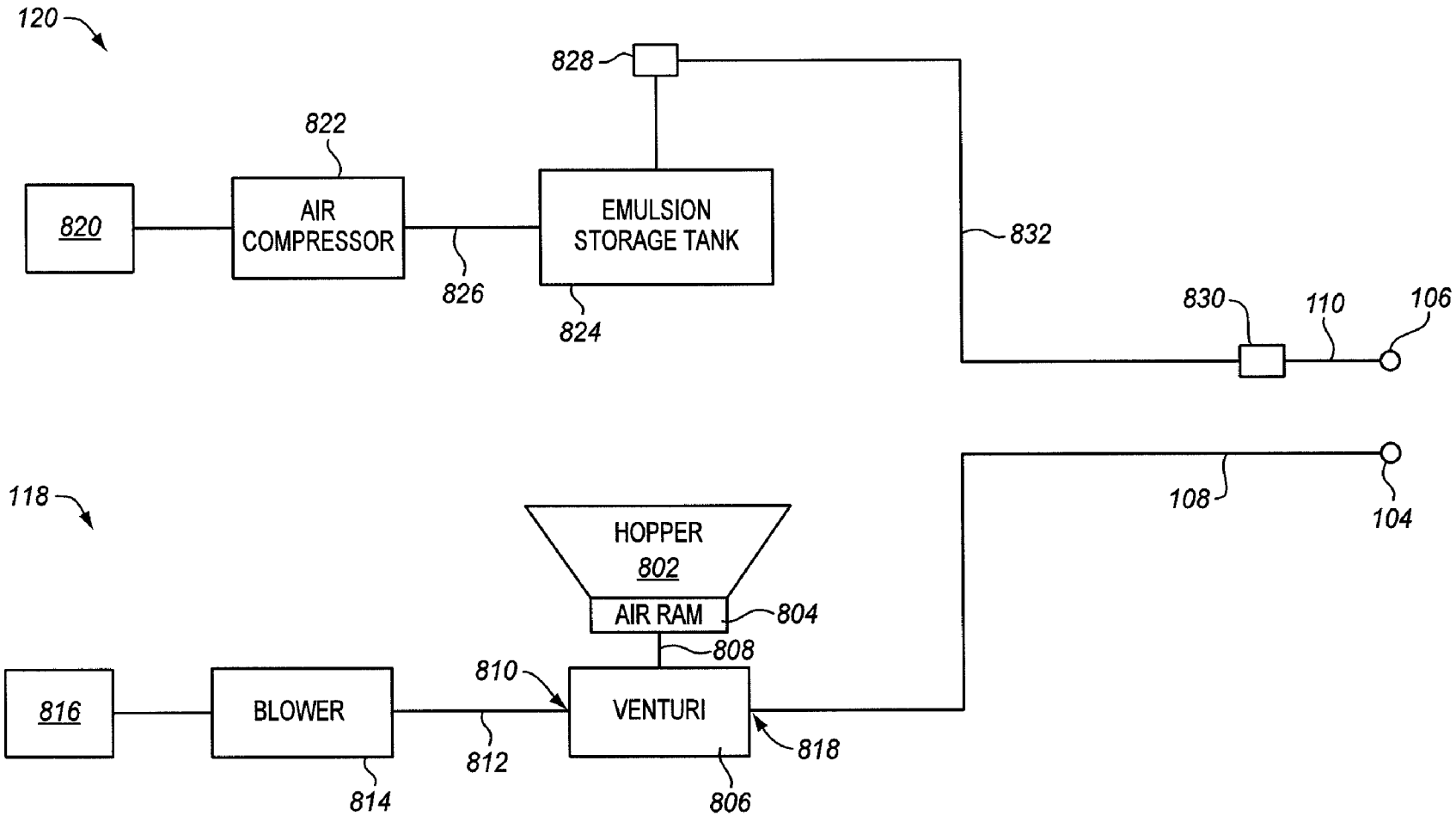
FIG. 8 is a block diagram of an aggregate distribution subsystem and an emulsion distribution subsystem, according to an embodiment.

FIG. 8 is a block diagram of aggregate distribution subsystem 118 and emulsion distribution subsystem 120. Aggregate distribution subsystem 118 provides aggregate material to aggregate dispensing nozzle 104 via aggregate hose 108. Emulsion distribution subsystem 120 provides asphalt emulsion to emulsion dispensing nozzle 106 via emulsion line 110.

Aggregate distribution system 118 includes hopper 802 for storing bulk aggregate material. A vibrator (not shown) may be located within hopper 802. The vibrator may be used to prevent undesired amalgamation of bulk aggregate material within hopper 802. The vibrator, if present, is controlled by electric control subsystem 902, which is discussed in more detail below with respect to FIG. 11.

Air ram 804 is disposed below hopper 802, and air ram 804 is in fluid communication with an opening in the bottom of hopper 802. Air ram 804 acts as a valve to control the flow of aggregate material through the opening in the bottom of hopper 802. Air ram 804 is controlled by electric control subsystem 902, which is discussed in more detail below with respect to FIG. 11.

Venturi 806 is disposed below air ram 804. Venturi 806 includes three openings. Opening 808, which is in fluid communication with air ram 804, allows aggregate material to fall from hopper 802 into venturi 806 under the force of gravity if air ram 804 is open. If air ram 804 is closed, aggregate material can not fall into venturi 806.

Opening 810 is connected to hose 812 which is in turn connected to blower 814. Blower 814 may be powered by rotational energy source 816. In an embodiment, rotational energy source 816 may be a dedicated diesel engine; rotational energy source 816 and rotational energy source 820 of emulsion distribution subsystem 120 may also be a common diesel engine. Rotational energy source 816 is for example controlled by electric control subsystem 902, which is discussed in more detail below with respect to FIG. 11. In an embodiment, blower 814 delivers air into hose 812 at a maximum rate of 450 cubic feet per minute (CFM) and at a maximum pressure of ten pounds per square inch (PSI).

Opening 818 of venturi 806 is connected to aggregate hose 108. Aggregate hose 108 is connected to aggregate dispensing nozzle 104.

Aggregate distribution subsystem 118 illustratively operates as follows. In an operating mode where aggregate distribution subsystem 118 is delivering aggregate material to aggregate dispensing nozzle 104, air ram 804 is open. Blower 814 then injects air into venturi 806 via hose 812. Venturi 806 speeds the flow of air through venturi 806. Venturi 806 mixes the air with aggregate material from hopper 802 using the venturi air effect. The mixture of air and aggregate exits venturi 806 via opening 818 and is delivered to aggregate dispensing nozzle 104 via aggregate hose 108.

In an operating mode where aggregate distribution subsystem 118 is delivering solely air to aggregate dispensing nozzle 104, air ram 804 is closed. Consequently, aggregate material may not fall into venturi 806. Blower 814 delivers air to aggregate dispensing nozzle 104 via hose 812, venturi 806, and aggregate hose 108.

Emulsion distribution subsystem 120 includes air compressor 822, which is powered by rotational energy source 820, such as an engine or electric motor. In an embodiment, rotational energy source 820 and rotational energy source 816 may be a common diesel engine separate from the engine for vehicle 116. Rotational energy source 820 is for example controlled by electric control subsystem 902, which is discussed in more detail below with respect to FIG. 11. Air compressor 822 is connected to emulsion storage tank 824 via air line 826. Emulsion storage tank 824 stores asphalt emulsion. In an embodiment, asphalt emulsion storage tank 824 has a 250 gallon capacity and is rated to withstand a pressure of 200 PSI. Air compressor 822 pressurizes emulsion distribution subsystem 120 such that asphalt emulsion in emulsion storage tank 824 is under pressure when patcher system 100 is operating.

Valve 828 is in fluid communication with emulsion storage tank 824. An output of valve 828 is connected to control valve 830 via line 832. Control valve 830 is in turn connected to emulsion dispensing nozzle 106 via emulsion line 110. Control valve 830 controls the flow of asphalt emulsion to emulsion dispensing nozzle 106. In an embodiment, control valve 830 is located proximate to emulsion dispensing nozzle 106 on remotely controllable arm 102. Control valve 830 is controlled by electric control subsystem 902, which is discussed in more detail below with respect to FIG. 11.

Valve 828 has three positions. When valve 828 is in its closed position, no fluid may flow through valve 828 into emulsion line 832. When valve 828 is in its open condition, asphalt emulsion from emulsion storage tank 824 may flow into emulsion line 832. When valve 828 is in its clean position, a cleaning agent from a cleaning subsystem (not shown) in fluid communication with valve 828 may flow into emulsion line 832. The cleaning agent is used to clean a subset of emulsion distribution subsystem 120, including emulsion lines 110 and 832, control valve 830, and emulsion dispensing nozzle 106. In an embodiment, the cleaning agent is diesel fuel.

In an embodiment, emulsion storage tank 824 and/or emulsion lines 110 and 832 include one or more heating subsystems. The heating subsystems help keep emulsion in emulsion distribution subsystem 120 at an acceptable temperature.

Figure 9:
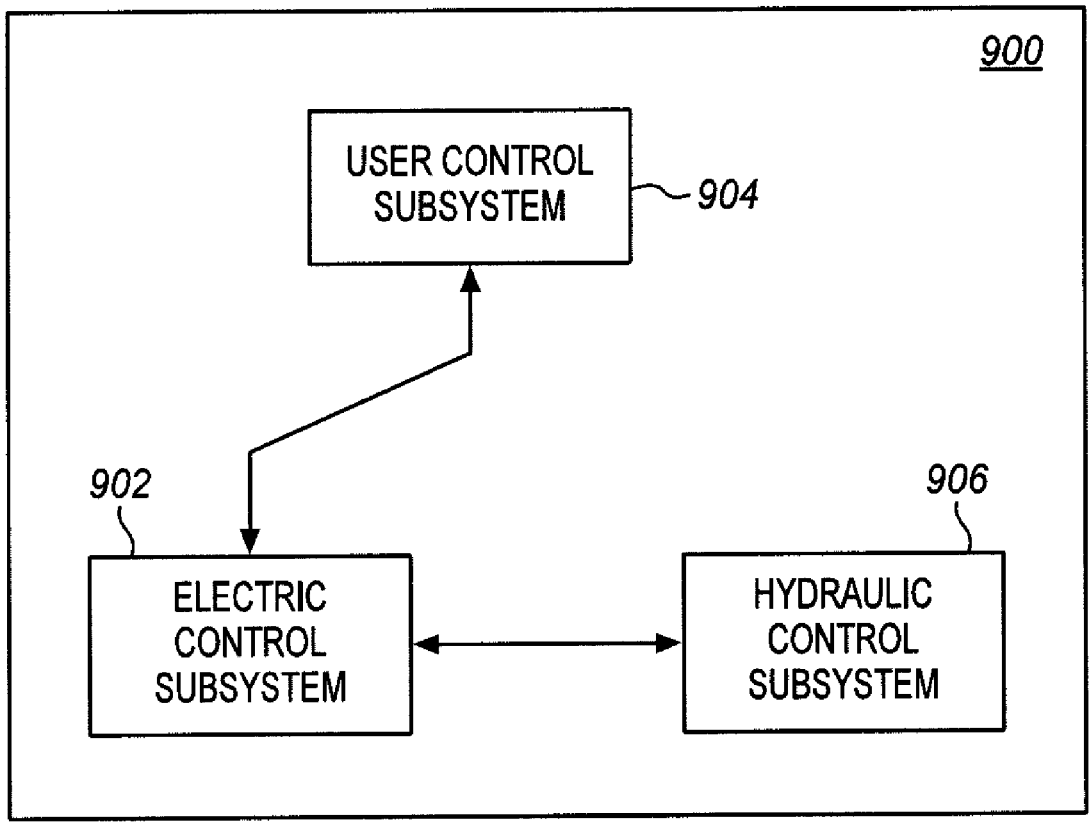
FIG. 9 is a block diagram of a control subsystem, according to an embodiment.

FIG. 9 is a block diagram of control subsystem 900. Control subsystem 900 controls operation of patcher system 100. Central to control subsystem 900 is electric control subsystem 902. Electric control subsystem 902 provides centralized control of patcher system 100. Electric control subsystem 902 is discussed in more detail below with respect to FIG. 11.

Figure 12:
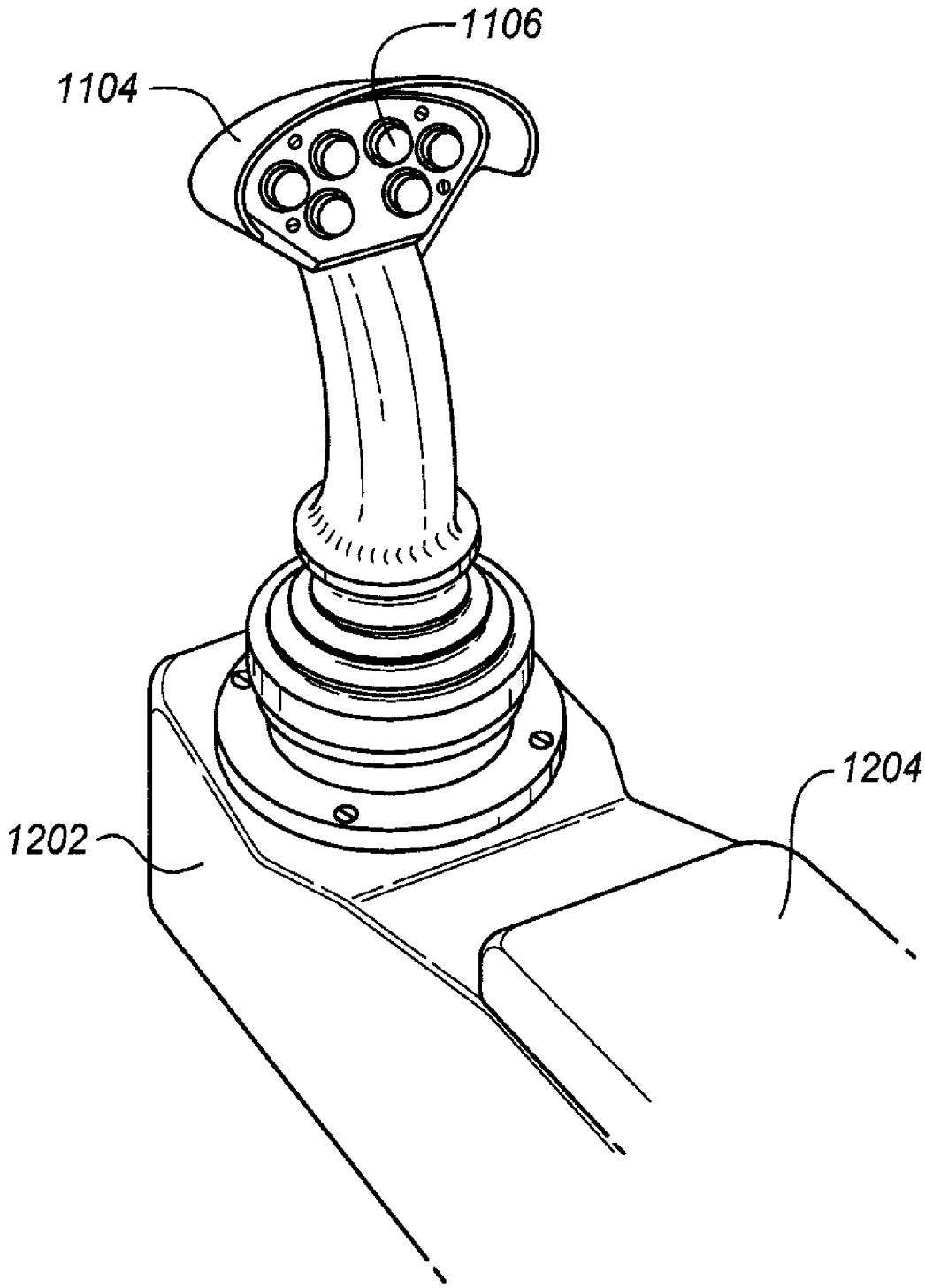
FIG. 12 is a perspective view of a user control subsystem, according to an embodiment.

Control subsystem 900 also includes user control subsystem 904 and hydraulic control subsystem 906. User control subsystem 904, discussed in more detail below with respect to FIG. 12, provides a user interface to electric control subsystem 902, in which a user may control one or more operations of patcher system 100. Hydraulic control subsystem 906, discussed in more detail below with respect to FIG. 10, directly controls remotely controllable arm 102 in response to electric signals received from electric control subsystem 902.

Figure 10:
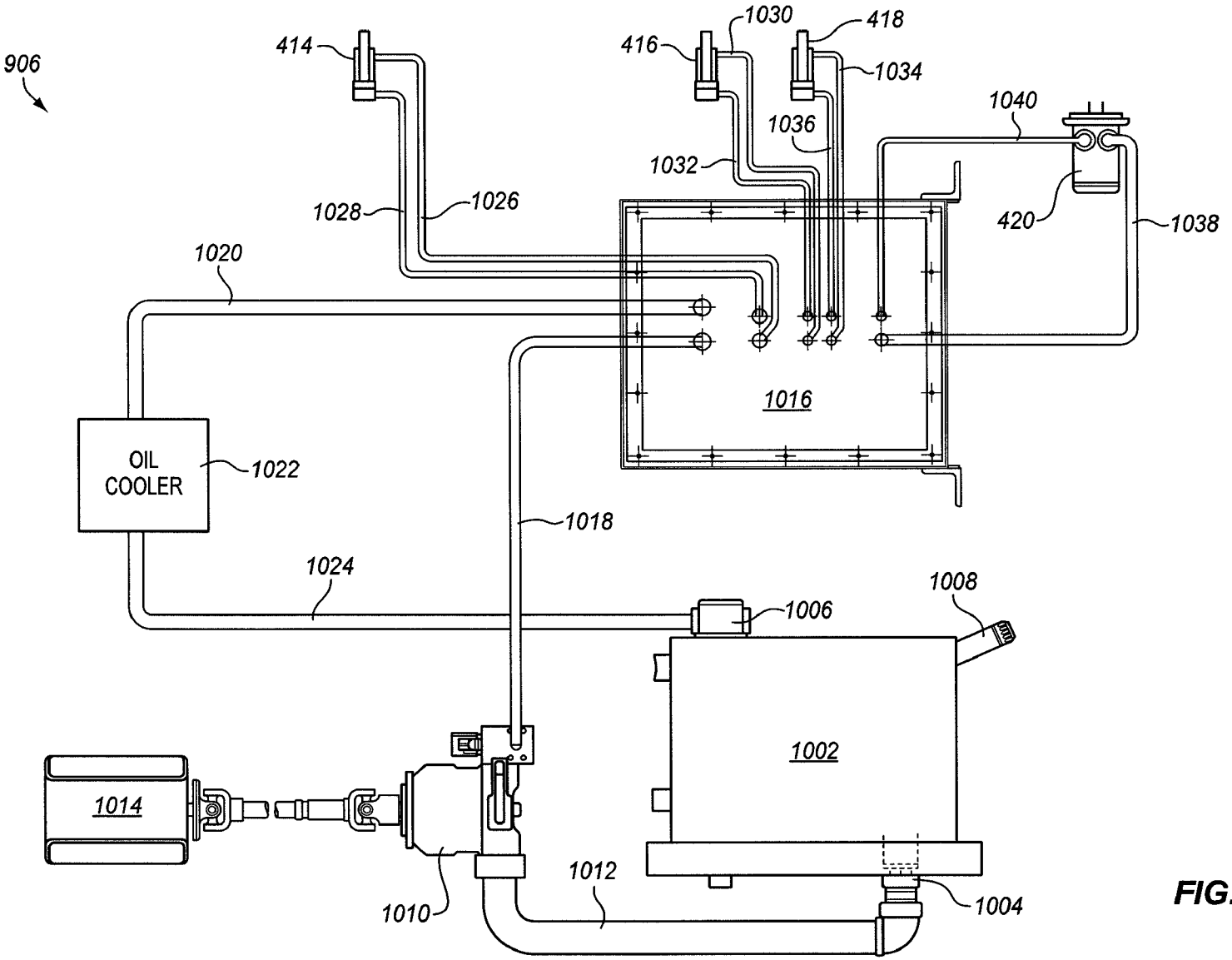
FIG. 10 is a block diagram of a hydraulic control subsystem, according to an embodiment.

FIG. 10 is a block diagram of hydraulic control subsystem 906, which may operate to control actuators 414, 416, and 418 as well as rotary actuator 420 of remotely controllable arm 102. Hydraulic control subsystem 906 includes reservoir 1002 to store hydraulic fluid. Reservoir 1002 includes outlet 1004, wherein hydraulic fluid exits reservoir 1002, and inlet 1006, wherein hydraulic fluid returns to reservoir 1002. Filler 1008 provides an opening for a user to add hydraulic fluid to reservoir 1002.

Hydraulic pump 1010 is connected to outlet 1004 via hydraulic line 1012. Hydraulic pump 1010 establishes an acceptable hydraulic pressure within hydraulic control subsystem 906 to enable hydraulic control subsystem 906 to control actuators 414, 416, and 418 as well as rotary actuator 420. Hydraulic pump 1010 is driven directly or indirectly by rotational energy source 1014. In an embodiment, rotational energy source 1014 is an engine or an electric motor. Hydraulic pump 1010 is for example controlled by electric control subsystem 902, which is discussed in more detail below with respect to FIG. 11.

Hydraulic pump 1010 is connected to hydraulic valve enclosure 1016 via hydraulic line 1018. Hydraulic valve enclosure 1016 controls the flow of hydraulic fluid to actuators 414, 416, and 418, as well as rotary actuator 420. Hydraulic valve enclosure 1016 includes a control valve (not shown) associated with each actuator; each control valve controls the flow of hydraulic fluid to its associated actuator in response to a control signal from electric control subsystem 902. Consequently, electric control subsystem 902 may be used to control operation of actuators 414, 416, and 418, and rotary actuator 420 via hydraulic control subsystem 906. In an embodiment, electric control subsystem 902 provides a pulse width modulated (PWM) signal to each control valve.

Hydraulic fluid returns from hydraulic valve enclosure 1016 to reservoir 1002 via hydraulic line 1020, oil cooler 1022, and hydraulic line 1024. Oil cooler 1022 cools the hydraulic fluid within hydraulic control subsystem 906. In an embodiment, oil cooler 1022 is a forced air cooling unit.

Actuator 414 is connected to hydraulic valve enclosure 1016 via supply hydraulic line 1026 and return hydraulic line 1028; actuator 416 is connected to hydraulic valve enclosure 1016 via supply hydraulic line 1030 and return hydraulic line 1032; and actuator 418 is connected to hydraulic valve enclosure 1016 via supply hydraulic line 1034 and return hydraulic line 1036. Rotary actuator 420 is connected to hydraulic valve enclosure 1016 via supply hydraulic line 1038 and return hydraulic line 1040. Each supply line delivers hydraulic fluid from hydraulic valve enclosure 1016 to an actuator; each return line returns hydraulic fluid from an actuator to hydraulic valve enclosure 1016.

Figure 11:
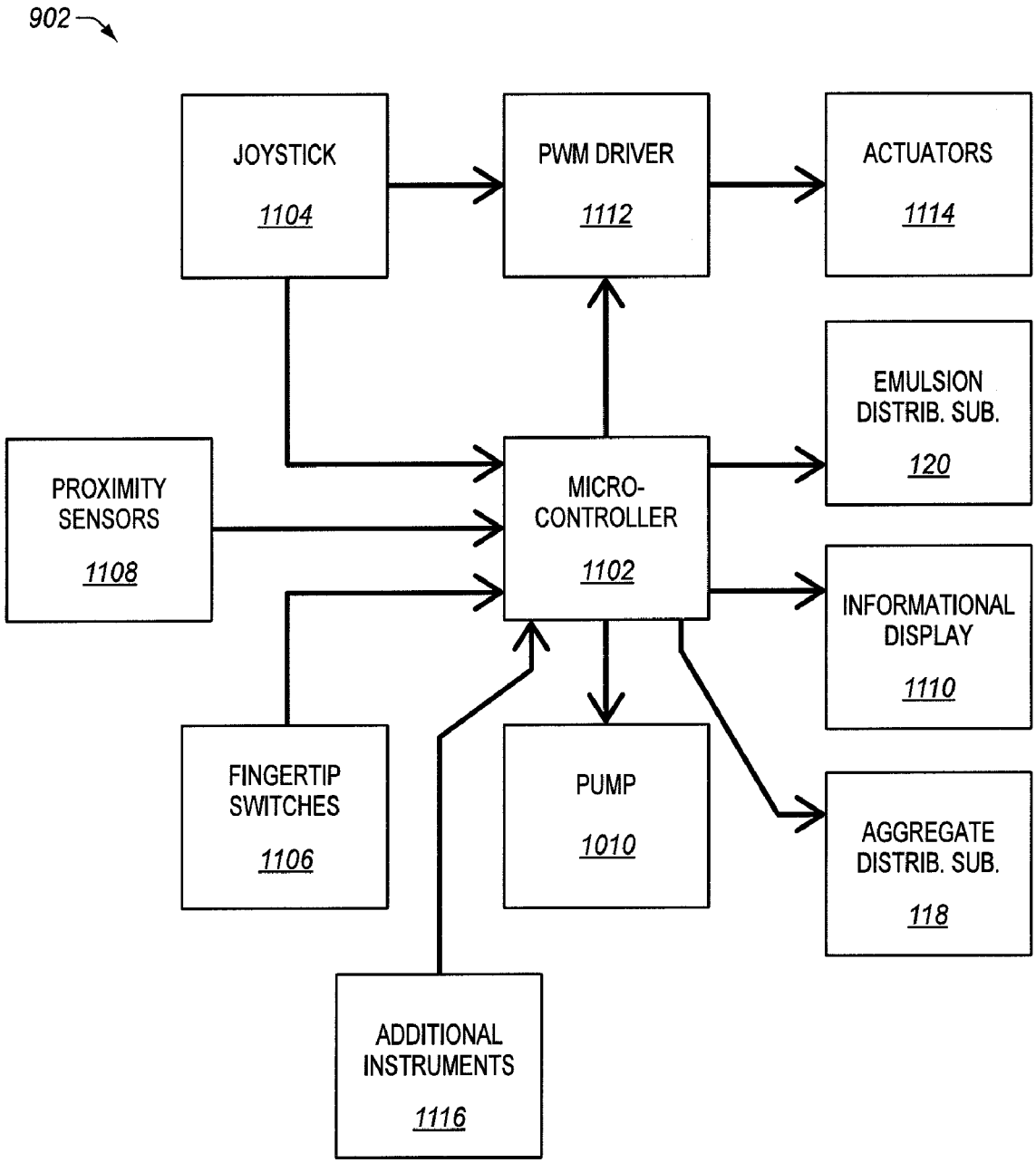
FIG. 11 is a block diagram of an electric control subsystem, according to an embodiment.

FIG. 11 is a block diagram of electric control subsystem 902 which provides centralized control of patcher system 100. In an embodiment, electric control subsystem 902 is housed in a chassis which is installed in passenger compartment 124 of vehicle 116. Electric control subsystem 902 may operate from a direct current electric power source ranging from nine to sixteen volts, for example.

Electric control subsystem 902 is controlled by microcontroller 1102. Microcontroller 1102 is for example a general purpose microprocessor that is field-replaceable. In an embodiment, microcontroller 1102 has at least 24 digital inputs, 16 digital outputs, 11 analog inputs, 4 analog outputs, and two serial ports.

As illustrated in FIG. 11, a plurality of subsystems provide input signals to microcontroller 1102. Joystick 1104 and fingertip switches 1106, discussed in more detail with respect to FIG. 12, provides user input signals to microcontroller 1102. Proximity sensors 1108, which indicate when remotely controllable arm 102 has reached one or more predetermined positions, also provide input signals to microcontroller 1102. Proximity sensors 1108 may be active when remotely controllable arm 102 has reached one or more predetermined positions. Additional instruments 1116 may provide additional input signals to microcontroller 1102; additional instruments 1116 may for example include a sensor that is operable to detect a low level of hydraulic fluid in reservoir 1002 and a sensor that is operable to detect a dirty hydraulic fluid filter in hydraulic control subsystem 906.

Microcontroller 1102 controls patcher system 100 by receiving input signals from joystick 1104, fingertip switches 1106, proximity sensors 1108, and additional instruments 1116 and by generating predetermined output signals in response to these input signals. Computer programming instructions, such as firmware or software, determine what output signals microcontroller 1102 generates in response to receiving input signals. The firmware or software of microcontroller 1102 is for example field-upgradeable.

Microcontroller 1102 provides a plurality of output signals to control operation of patcher system 100. Microcontroller 1102 provides an output signal to control operation of hydraulic pump 1010. Consequently, electric control subsystem 902 controls when hydraulic control subsystem 906 is pressurized. In one example of operation, microcontroller 1102 provides control signals to emulsion control valve 830 and rotational energy source 820 of emulsion distribution subsystem 120. Consequently, in this embodiment, electric control subsystem 902 controls the delivery of asphalt emulsion to emulsion dispensing nozzle 106. Microcontroller 1102 provides control signals to air ram 804, rotational energy source 816, and a vibrator in hopper 802 (if present) of aggregate distribution subsystem 118. Consequently, electric control subsystem 902 controls the delivery of aggregate material and air to aggregate dispensing nozzle 104. Microcontroller 1102 provides an output signal to informational display 1110, which is discussed in more detail with respect to FIG. 13.

Microcontroller 1102 provides input signals to PWM driver 1112. PWM driver 1112 provides PWM electric control signals to actuators 414, 416, and 418 as well as to rotary actuator 420, all represented by actuators 1114 in FIG. 1. The PWM signals may have a current level limited to a predetermined maximum current level. As indicated in FIG. 11, PWM driver 1112 also receives input signals from joystick 1104. Consequently, actuators 414, 416, and 418 and rotary actuator 420 are indirectly controlled both by joystick 1104 and microcontroller 1102.

FIG. 12 is a perspective view of user control subsystem 904 disposed within passenger compartment 124 of vehicle 116. User control subsystem 904 includes joystick 1104, fingertip switches 1106, and a user controllable trigger (not visible in FIG. 12). User control subsystem 904 allows a user to control one or more operations of patcher system 100. In an embodiment, use control subsystem 904 includes base 1202 which supports joystick 1104. Base 1202 may include padded armrest 1204 to increase user comfort while the user is operating patcher system 100.

Joystick 1104 allows a user to control a position of remotely controllable arm 102. In an embodiment, joystick 1104 is a single three dimensional control instrument providing three dimensional control signals to microcontroller 1102, thereby permitting a user to control the position of remotely controllable arm 102 three-dimensionally relative to vehicle 116. Three one dimensional joysticks may be used in place of a single three dimensional joystick.

Fingertip switches 1106 allow the user to control operation of one or more subsystems of patcher system 100. For example, fingertip switches 1106 may allow a user to control operation of aggregate distribution subsystem 118, emulsion distribution subsystem 120 and hydraulic pump 1010. Fingertip switches 1106 may control electric power to patcher system 100 and may allow a user to stow remotely controllable arm 102; they may contain lights indicating the positions of the switches.

In an embodiment, the user controllable trigger interacts with microcontroller 1102 and its software or firmware to prevent a user from inadvertently moving remotely controllable arm 102. In this embodiment, the user may not move remotely controllable arm 102 via joystick 1104 unless the user activates the trigger while moving the joystick.

Figure 13:
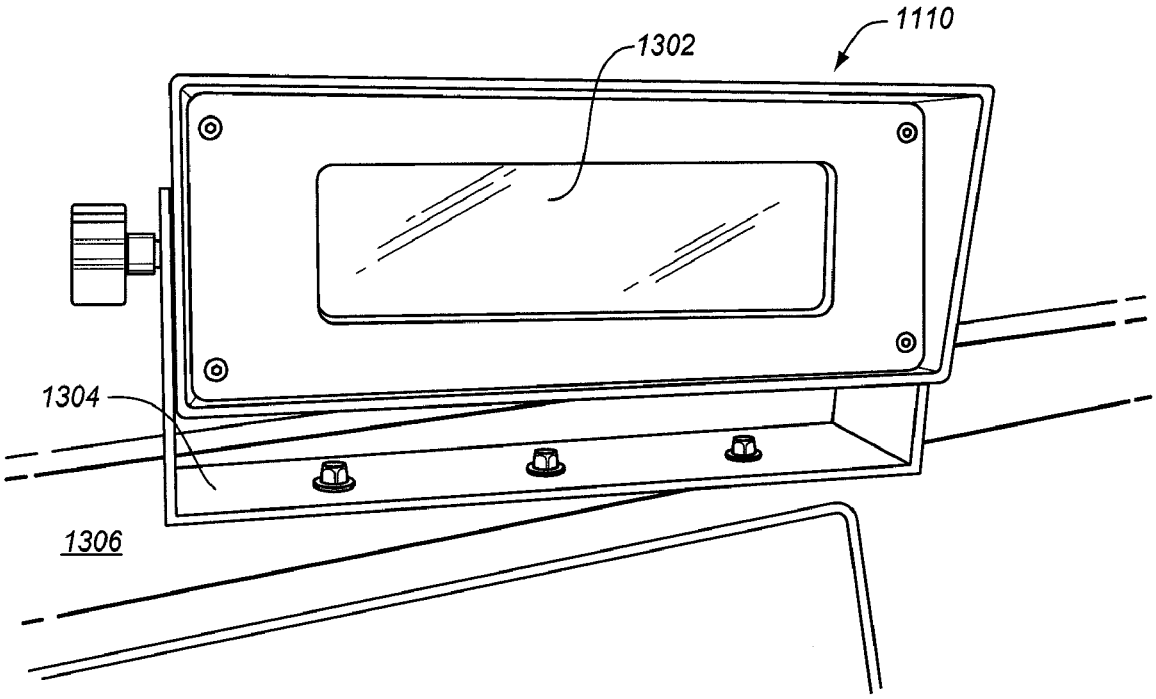
FIG. 13 is a perspective view of an informational display, according to an embodiment.

FIG. 13 is a perspective view of informational display 1110. Information display 1110, which is an optional accessory to patcher system 100, indicates to a user one or more operating states of patcher system 100. For example, informational display 1110 may display which of a plurality of joystick 1104 functions are activated. As another example, informational display 1110 may also display operating states of aggregate distribution subsystem 118, emulsion distribution subsystem 120, or hydraulic control subsystem 906.

Informational display 1110 is connected to electric control subsystem 902 in a suitable manner. For example, informational display 1110 may be connected to electric control subsystem 902 by an electrical, optical, or wireless interface. In an embodiment, informational display 1110 is connected to microcontroller 1102 of electric control subsystem 902 via a RS-232 interface.

Informational display 1110 includes screen 1302 to display patcher system 100 operating information. Screen 1302 may be backlit and include a liquid crystal display. Information display 1110 also includes bracket 1304 which provides a structure to mount informational display 1110 to vehicle dashboard 1306.

Figure 14:
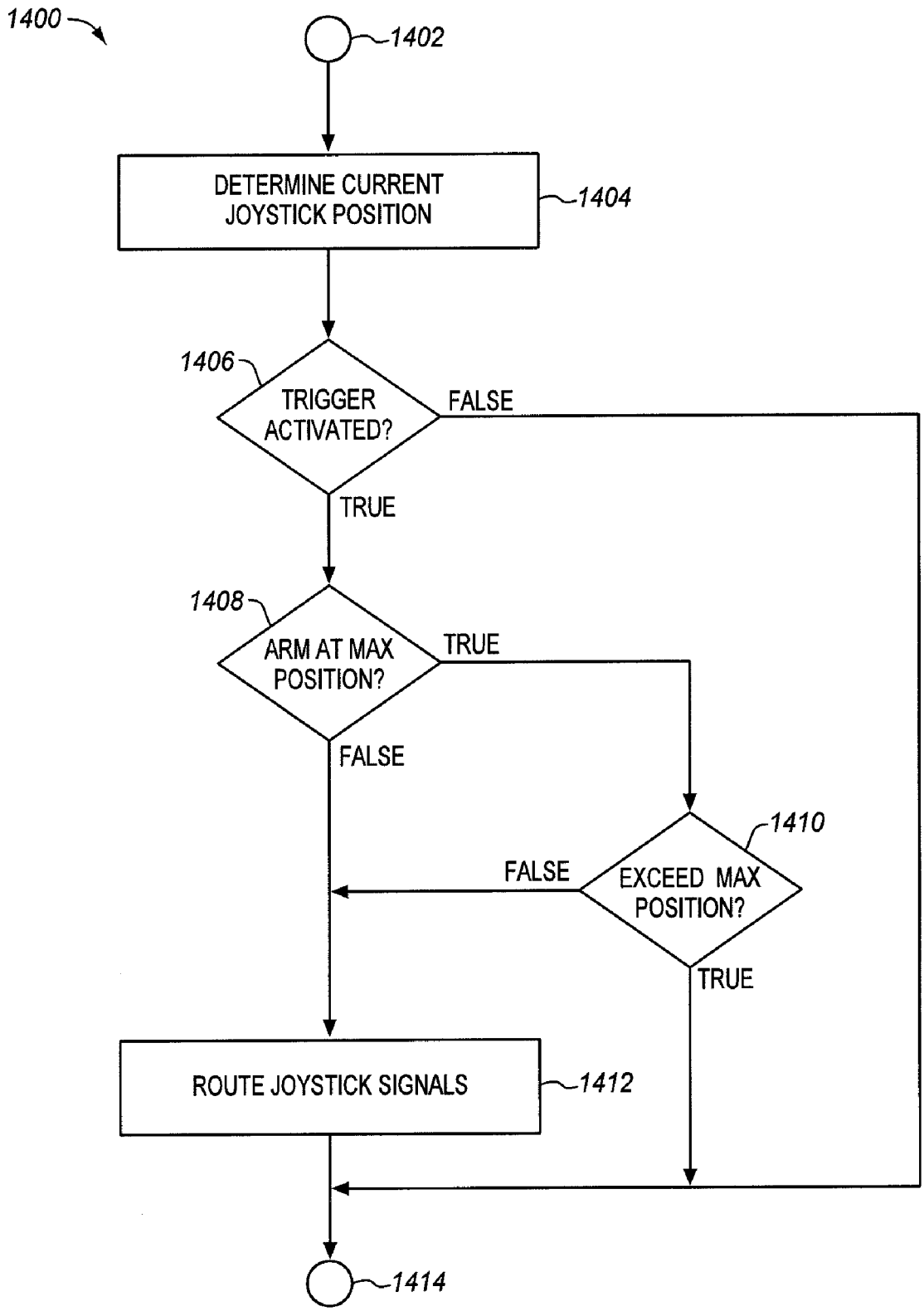
FIG. 14 schematically shows a method of controlling a position of a remotely controllable arm, according to an embodiment.

FIG. 14 shows method 1400 which illustratively shows how microcontroller 1102 may control the position of remotely controllable arm 102 in response to a user's movement of joystick 1104. Method 1400 is for example implemented by operations or processes of micro-controller 1102 under control of software or firmware. Method 1400 begins at step 1402 and proceeds to step 1404 wherein the current position of joystick 1104 is determined. Decision 1406 determines whether a user has activated a trigger on joystick 1104. If the result of decision 1406 is false, remotely controllable arm 102 should not be moved, and method 1400 terminates at step 1414. If the result of decision 1406 is true, method 1400 proceeds to decision 1408.

In decision 1408, method 1400 determines via signals from proximity sensors 1108 whether remotely controllable arm 102 has reached one or more of its maximum operating positions and, therefore, cannot be extended any further in at least one direction. If the result of decision 1408 is false, method 1400 proceeds to step 1412 wherein signals representing the current position of joystick 1104 are routed to actuators 1114. Actuators 1114 adjust the position of remotely controllable arm 102 as required so that the position of remotely controllable arm 102 is in accordance with the current position of joystick 1104. Step 1412 proceeds to step 1414, wherein method 1400 terminates.

If the result of decision 1408 is true, method 1400 proceeds to decision 1410. Decision 1410 determines whether movement of remotely controllable arm 102 in accordance with the current position of joystick 1104 would place remotely controllable arm 102 outside of one or more of its maximum operating positions. If the result of decision 1410 is true, remotely controllable arm 102 should not be moved further, and method 1400 proceeds to step 1414, wherein it terminates. If the result of decision 1410 is false, remotely controllable arm 102 may be moved in accordance with the current position of joystick 1104, and method 1400 proceeds to step 1412.

Figure 15:
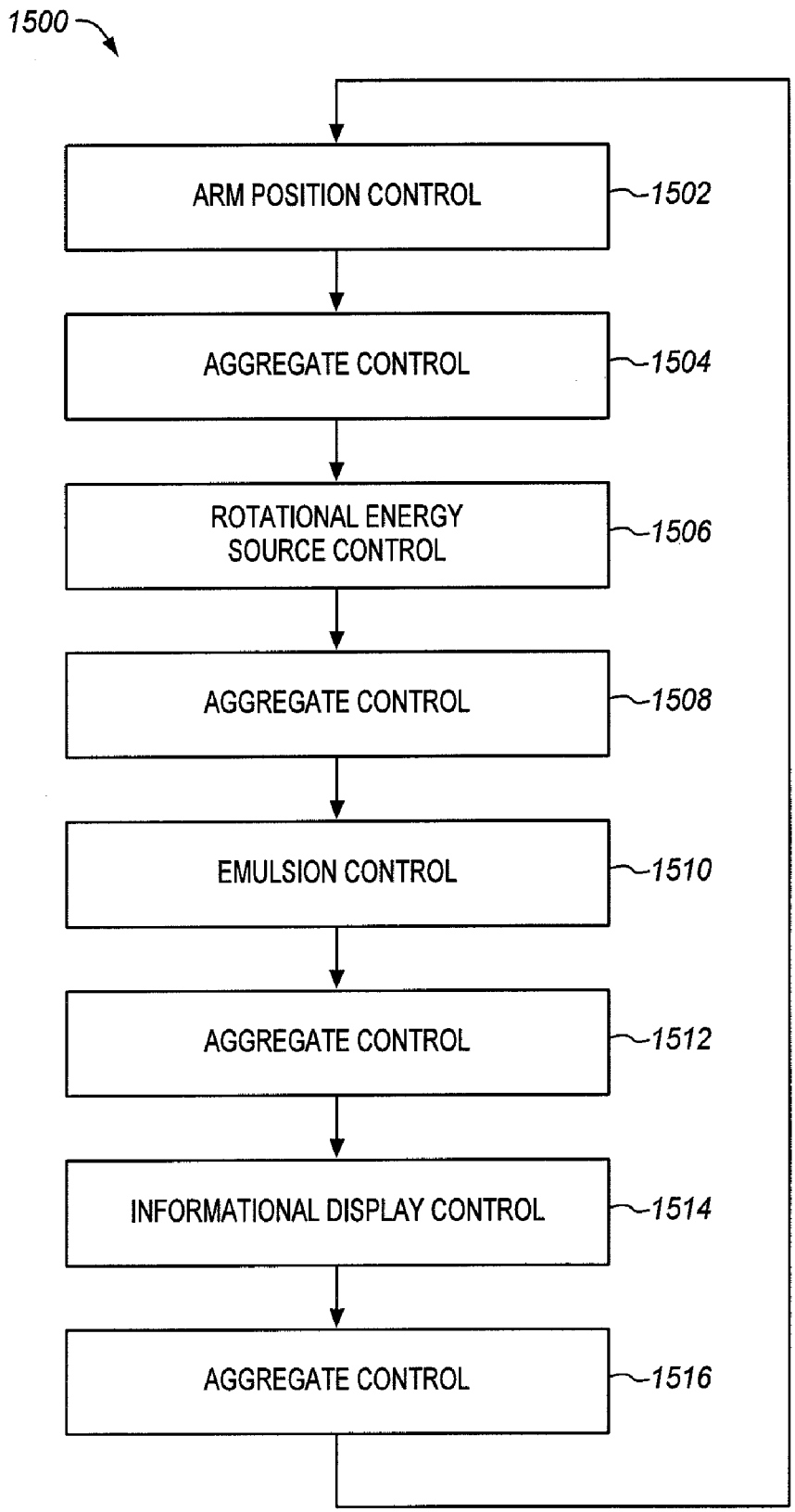
FIG. 15 schematically shows a method of controlling an operation of a patcher system, according to an embodiment.

FIG. 15 shows method 1500 which illustratively shows how microcontroller 1102 may execute a plurality of discrete subroutines in a continuous loop. Method 1500 includes subroutines or steps 1502, 1504, 1506, 1508, 1510, 1512, 1514, and 1516 which are executed by microcontroller 1102 in a continuous loop.

In step 1502, a method of controlling the position of remotely controllable arm 102 in response to a user's movement of joystick 1104 is executed. In an embodiment, method 1400 of FIG. 14 is executed in step 1502.

In steps 1504, 1508, 1512, and 1516, a method of controlling operation of aggregate distribution subsystem 118 is executed. In an embodiment, operating states of air ram 804 and a vibrator within hopper 802 (if present) are adjusted in accordance with positions of one or more fingertip switches 1106 on joystick 1104. The method of controlling operation of aggregate distribution subsystem 118 is executed four times in method 1500 in order to effectively increase the priority of the control of aggregate distribution subsystem 118 over other control functions in method 1500. The control of aggregate distribution subsystem 118 is given higher priority than other control functions in method 1500 to reduce the likelihood of aggregate distribution subsystem 118 becoming inadvertently jammed when a user requests that the flow of aggregate material be slowed and when microcontroller 1102 is simultaneously busy and therefore unable to slow aggregate distribution subsystem 118.

In step 1506, a method of controlling rotational energy sources 816 and/or 820 is executed. In an example of step 1506, operating speeds of rotational energy sources 816 and/or 820 are adjusted in accordance with positions of one or more fingertip switches 1106 on joystick 1104.

In step 1510, a method of controlling operation of emulsion control distribution subsystem 120 is executed. In an example of step 1510, the operating state of emulsion control valve 830 is adjusted in accordance with positions of one or more fingertip switches 1106 on joystick 1104.

In step 1514, a method of controlling operation of informational display 1110 is executed. In an example of step 1514, information display 1110 is operated such that it displays one or more operation conditions of patcher system 100. The status of emulsion distribution subsystem 120 may be displayed in step 1514.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

I claim:

1. A software product comprising instructions, stored on computer-readable media, wherein the instructions, when executed by a computer, perform steps for limiting range of movement of a remotely controllable arm mounted to a patcher system vehicle to less than analogously available movement of a joystick for controlling the arm, the steps comprising:

determining a current position of the joystick;

determining if the remotely controllable arm has reached a maximum position relative to a side of the vehicle; and if the remotely controllable arm has not reached the maximum position relative to the side of vehicle, routing signals corresponding to the current position of the joystick to actuators associated with the remotely controllable arm.

2. The software product of claim 1, the maximum position relative to the side of the vehicle being a position at a driver's side of the vehicle.

3. The software product of claim 1, the maximum position relative to the side of the vehicle being a position at a predetermined distance beyond a passenger's side of the vehicle.

4. A system for controlling a position of a remotely controllable arm mounted to a patcher system vehicle, comprising a joystick for a user to indicate a desired position of the remotely controllable arm;

a proximity sensor for indicating if the remotely controllable arm has reached a maximum position relative to a side of the vehicle; and a microcontroller communicatively coupled to the joystick and the proximity sensor, the microcontroller configured and arranged to allow movement of the remotely controllable arm to the desired position only if the movement would not result in the remotely controllable arm exceeding the maximum position relative to the side of the vehicle.

5. The system of claim 4, the maximum position relative to the side of the vehicle being a position at a driver's side of the vehicle.

6. The system of claim 4, the maximum position relative to the side of the vehicle being a position at a predetermined distance beyond a passenger's side of the vehicle.

7. A method for controlling a mobile patcher system for patching a paved surface with patching material, wherein the system includes a remotely controllable arm, an aggregate distribution subsystem for dispensing aggregate material via the remotely controllable arm, and an emulsion distribution system for dispensing emulsion material via the remotely controllable arm, the method comprising executing on a microprocessor in a continuous loop:

a first subroutine for controlling a position of the remotely controllable arm;

a second subroutine for controlling the aggregate distribution subsystem; and a third subroutine for controlling the emulsion distribution subsystem;

wherein the second subroutine for controlling the aggregate distribution subsystem is executed a greater number of times in the continuous loop than either the first subroutine for controlling the position of the remotely controllable arm or the third subroutine for controlling the emulsion distribution subsystem.

* * * * *

UNITED STATES PATENT AND TRADEMARK OFFICE

CERTIFICATE OF CORRECTION

PATENT NO. : 7,729,836 B2
APPLICATION NO. : 12/348836
DATED : June 1, 2010
INVENTOR(S) : Robert A. Gilchrist It is certified that error appears in the above-identified patent and that said Letters Patent is hereby corrected as shown below:

Column 1, Line 28, “an utility” should read --a utility--;
Column 4, Line 40, “a exploded” should read --an exploded--; Line 55, “may” should read --may be--;
Column 5, Line 44, “can not” should read --cannot--;

Signed and Sealed this

Seventh Day of December, 2010

David J. Kappos

David J. Kappos
*Director of the United States Patent and Trademark Office*